US005868562A

United States Patent [19]

Watanabe et al.

[11] Patent Number: 5,868,562

[45] Date of Patent: Feb. 9, 1999

[54] PAINT DRYING FURNACE

[75] Inventors: Makoto Watanabe; Isao Ohashi, both of Shinjuku-ku; Hisashi Umeda, Hazu-gun; Koji Hayashi, Nagoya; Gen Kusunoki, Nisshin, all of Japan

[73] Assignee: Kaikisha Ltd., Tokoyo, Japan

[21] Appl. No.: 849,603

[22] PCT Filed: Oct. 2, 1996

[86] PCT No.: PCT/JP96/02883

§ 371 Date: Oct. 6, 1997

§ 102(e) Date: Oct. 6, 1997

[87] PCT Pub. No.: WO97/12690

PCT Pub. Date: Apr. 10, 1997

[30] Foreign Application Priority Data

Oct. 3, 1995 [JP] Japan ..... 7-256028

[51] Int. Cl.[6] ..... F22B 7/00

[52] U.S. Cl. ..... 432/21; 432/176; 432/152

[58] Field of Search ..... 432/21, 29, 48, 432/152, 176, 199, 72; 34/77, 78, 79, 219, 478, 479

[56] References Cited

U.S. PATENT DOCUMENTS

| | | | |
|---|---|---|---|
| 3,909,953 | 10/1975 | Hemsath | 34/479 |
| 4,092,100 | 5/1978 | Phillips | 432/72 |
| 4,116,620 | 9/1978 | Stibbe | 432/59 |
| 4,384,850 | 5/1983 | Dixon | 432/176 |
| 4,460,331 | 7/1984 | Robson et al. | 432/21 |
| 4,654,003 | 3/1987 | Fishwick et al. | 432/35 |
| 4,656,758 | 4/1987 | Nakayama | 432/152 |
| 4,670,994 | 6/1987 | Takata et al. | 34/39 |
| 4,720,261 | 1/1988 | Fishwick et al. | 432/36 |
| 4,769,925 | 9/1988 | Matsubara | 34/243 |

FOREIGN PATENT DOCUMENTS

| | | | |
|---|---|---|---|
| 3326560 | 2/1985 | Germany | B05C 15/00 |
| 8000183 | 2/1980 | Japan | F26B 21/00 |
| 61-129066 | 6/1986 | Japan . | |
| 61-161173 | 7/1986 | Japan . | |
| 61-174967 | 8/1986 | Japan . | |
| 61-185359 | 8/1986 | Japan . | |
| 290970 | 3/1990 | Japan . | |
| 2139067 | 5/1990 | Japan . | |
| 531435 | 2/1992 | Japan . | |
| 4141273 | 5/1992 | Japan . | |
| 556195 | 8/1993 | Japan . | |
| 71556372 | 6/1995 | Japan . | |
| 8100448 | 2/1981 | Sweden | F26B 21/04 |
| 2059032 | 4/1981 | United Kingdom | F23G 7/06 |
| 8501098 | 3/1985 | United Kingdom | F26B 25/00 |
| 8000183 | 2/1980 | WIPO . | |
| 9201897 | 2/1992 | WIPO | F26B 23/02 |

*Primary Examiner*—Teresa J. Walberg
*Assistant Examiner*—Gregory A. Wilson
*Attorney, Agent, or Firm*—Fulbright & Jaworski, LLP

[57] ABSTRACT

Disclosed is a paint drying furnace for baking and drying paint films on painted objects following a painting process. The furnace of the invention has an interior combustion type heating device arranged on fresh air passages upstream of points of connection to furnace interior circulating gas passages for heating passing fresh air. The combustion type heating device is a direct heating type, combustion type heating device for burning a fuel directly in an atmosphere of passing fresh air to be heated.

7 Claims, 4 Drawing Sheets

PRIOR ART

PAINT DRYING FURNACE

TECHNICAL FIELD

This invention relates to paint drying furnaces for baking and drying paint films on painted objects following a painting process, more particularly to a paint drying furnace having furnace interior circulating gas passages for withdrawing furnace gases from furnace interiors and returning the withdrawn gas to the furnace interiors again, fresh air passages connected to the furnace interior circulating gas passages for mixing fresh air into the gases circulating through the furnace interior circulating gas passages, and furnace interior heating means for heating, to a high temperature, the gases returned from the furnace interior circulating gas passages to the furnace interiors to heat the furnace interiors.

BACKGROUND OF THE INVENTION

Conventionally, as shown in FIG. 5, a paint drying furnace as noted above has, acting as furnace interior heating means Hb, Hc for heating, to a high temperature, gases RA' returned from furnace interior circulating gas passages 9*b*, 9*c* to furnace interiors 1*b*, 1*c*, combustion type heating devices 19*b*', 19*c*' disposed on the furnace interior circulating gas passages 9*b*, 9*c* for heating gases RA circulating through the furnace interior circulating gas passages 9*b*, 9*c* by burning operation of burners b.

As the above combustion type heating devices 19*b*', 19*c*' for the furnace interiors, it is necessary to employ indirect heating type, combustion type heating devices in which burning flames and combustion gas G produced by the burning operation of burners b and the gases RA circulating through the furnace interior circulating gas passages 9*b*, 9*c* to be heated exchange heat in a non-contact mode through inner heat exchangers hx.

Where direct heating type, combustion type heating devices are employed as the combustion type heating devices 19*b*', 19*c*' for the furnace interiors, which burn a fuel directly in the atmosphere of gases RA circulating through the furnace interior circulating gas passages 9*b*, 9*c*, paint solvent vapor generated in the furnace interiors 1*b*, 1*c* during a baking and drying process and included in the gases RA circulating through the furnace interior circulating gas passages 9*b*, 9*c* is directly exposed and reacts to the burning flames in the combustion type heating devices 19*b*', 19*c*', to produce a reaction product which lowers paint film quality (i.e. a reaction product which adheres to the paint films after return to the furnace interiors 1*b*, 1*c* to lower paint film quality). The above construction is employed in order to prevent formation of such a reaction product. In FIG. 5, 8*b*, 8*c* denote furnace interior exhaust passages for discharging as exhaust gas EA from the system, part of furnace interior gases ZA withdrawn from the furnace interiors 1*b*, 1*c*. 18*b*', 18*c*' denote fresh air passages for mixing fresh air OA (usually ambient air) in a quantity corresponding to the exhaust gas from the furnace interior exhaust gas passages 8*b*, 8*c* into the gases RA circulating through the furnace interior circulating gas passages 9*b*, 9*c* to dilute the solvent vapor produced in the furnace interiors 1*b*, 1*c*.

However, the above conventional furnace discharges from the system the combustion gas G retaining a large amount of heat after the heat exchange in the indirect heating type, combustion type heating devices 19*b*', 19*c*' with the gases RA circulating through the furnace interior circulating gas passages 9*b*, 9*c* (specifically, the circulating gases mixed with fresh air OA), and thus involves a great heat loss.

Moreover, the indirect heating type, combustion type heating devices 19*b*', 19*c*' including the inner heat exchangers hx have a large heat capacity, and require a large heating load in start-up times. These points pose a problem of high running cost.

In addition, the indirect heating type, combustion type heating devices 19*b*', 19*c*', with the inner heat exchangers hx, have a large, complicated construction, which poses a problem of requiring high apparatus cost and large installation space.

Having regard to the state of the prior art noted above, a primary object of this invention is to reduce the heat loss noted above while preventing formation of a reaction product which lowers paint film quality.

Another object is to reduce the heating load in start-up times, and yet to downsize and simplify the apparatus construction.

SUMMARY OF THE INVENTION

The above objects are fulfilled by the invention defined in the claims.

That is, a paint drying furnace of this invention is a paint drying furnace noted in the outset hereof and characterized in that:

said furnace interior heating means are combustion type heating devices arranged on said fresh air passages upstream of points of connection to said furnace interior circulating gas passages for heating passing fresh air, and these combustion type heating devices are direct heating type, combustion type heating devices for burning a fuel directly in an atmosphere of passing fresh air to be heated.

According to this invention, while direct heating type, combustion type heating devices are used as the furnace interior heating means for heating, to a high temperature, the gases to be returned from the furnace interior circulating gas passages to the furnace interiors, what is passed through these direct heating type, combustion type heating devices to be heated is fresh air containing no paint solvent vapor yet. Thus, the gases circulating through the furnace interior circulating gas passages and containing paint solvent vapor are not passed through the direct heating type, combustion type heating devices. This reliably avoids the problem of the paint solvent vapor being directly exposed and reacting to burning flames in the direct heating type, combustion type heating devices to produce a reaction product which lowers of paint film quality.

Moreover, the combustion gas generated in the direct heating type, combustion type heating devices is mixed with fresh air and then mixed into the gases circulating through the furnace interior circulating gas passages to contribute to heating of the furnace interiors. This involves a reduced heat loss compared with use of the indirect heating type, combustion type heating devices in which the combustion gas retaining a large amount of heat is discharged from the system. Further, the direct heating type, combustion type heating devices require no inner heat exchangers for allowing a heat exchange in non-contact mode between burning flames and combustion gas, and the gases to be heated. These devices have a smaller heat capacity and impose a less heating load in start-up times than the indirect heating type, combustion type heating devices.

Consequently, the paint drying furnace of this invention can reduce running cost markedly, compared with the conventional furnace, described hereinbefore, having the indirect heating type, combustion type heating devices arranged on the furnace interior circulating gas passages to act as the furnace interior heating means.

Moreover, since the direct heating type, combustion type heating devices require no inner heat exchangers, as noted above, the apparatus has a simple construction, compared with the indirect heating type, combustion type heating devices. Thus, compared with the conventional furnace, the apparatus cost may be reduced and the required installation space may be diminished.

This invention may be embodied as follows.

A combustion type exhaust cleaning device is provided for burning paint solvent vapor contained in exhaust gases from the furnace interiors to clean the exhaust gases, and a heat recovering heat exchanger is provided for allowing a heat exchange between the exhaust gases cleaned by this exhaust cleaning device and the fresh air to preheats the fresh air.

Said fresh air passages are air passages for leading the fresh air preheated at said heat recovering heat exchanger to said furnace interior circulating gas passages through said combustion type heating devices.

With this construction, the direct heating type, combustion type heating devices disposed on the fresh air passages are operated to burn a fuel in the atmosphere of preheated fresh air. This improves the combustion efficiency of the combustion type heating devices to promote a reduction in the running cost more effectively, compared with a mode of introducing fresh air, without being preheated, into the direct heating type, combustion type heating devices.

The various features of novelty which characterize the invention are pointed out with particularity in the claims annexed to and forming a part of this specification. For a better understanding of the invention, its operating advantages and specific objects obtained by its use, reference should be had to the accompanying drawings and descriptive matter in which there is illustrated and described a preferred embodiment of the invention.

DETAILED DESCRIPTION OF PREFERRED EMBODIMENTS

Figure 1:
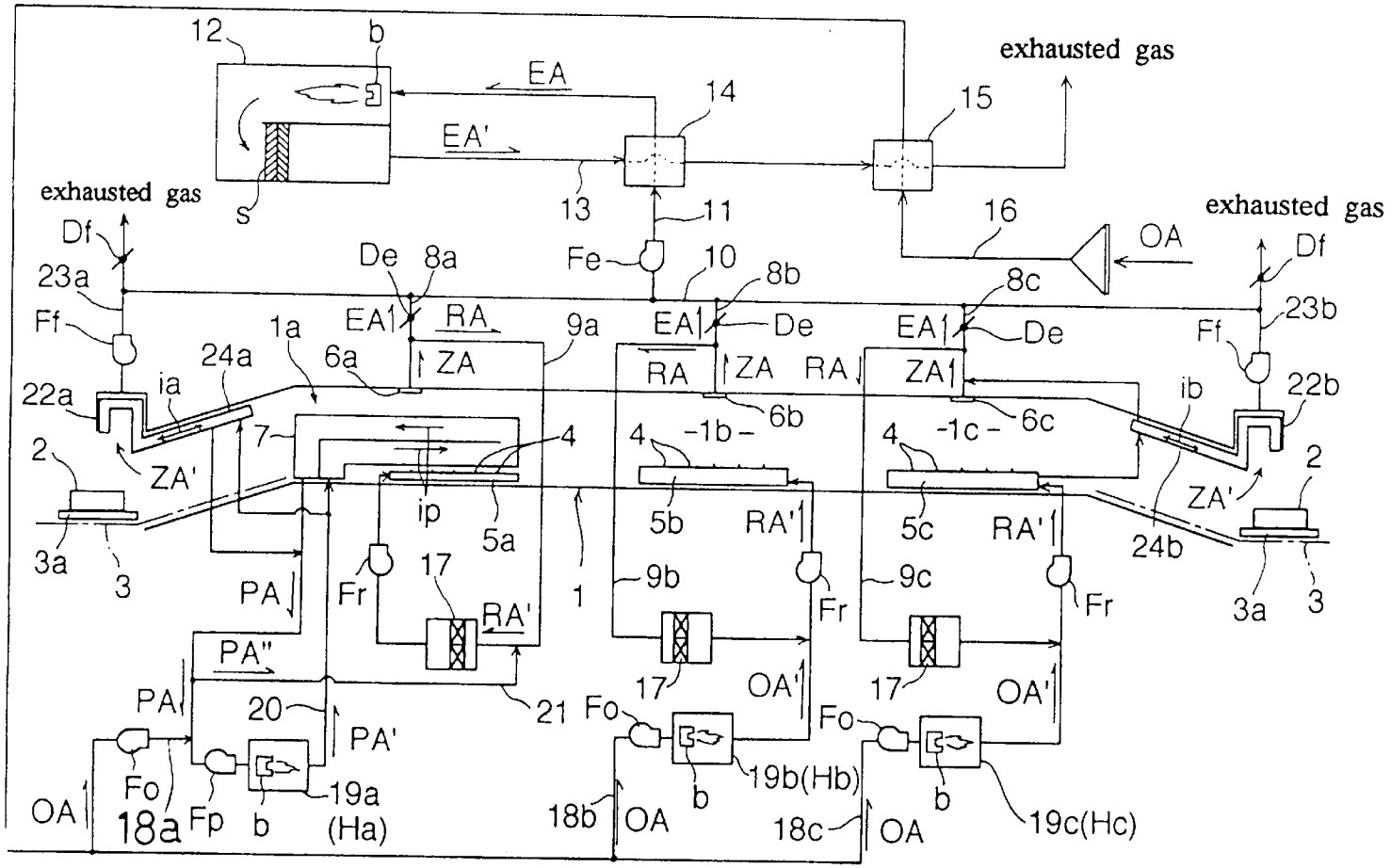
FIG. 1 is a view of an entire furnace.

In FIG. 1, 1 denotes a paint drying furnace for baking and drying paint films on painted objects 2 (which are automobile bodies in this example) following a painting process. The painted objects 2 mounted on carts 3*a* are transported by a conveyor apparatus 3 successively through a temperature increasing zone 1*a*, a first heat retaining zone 1*b* and a second heat retaining zone 1*c* in the furnace.

The respective zones 1*a*, 1*b*, 1*c* in the furnace have gas supply chambers 5*a*, 5*b*, 5*c* defining a plurality of hot gas supply openings 4, and exhaust openings 6*a*, 6*b*, 6*c* for withdrawing zone interior gases ZA. The temperature increasing zone 1*a* has, in addition to the gas supply chamber 5*a* and exhaust opening 6*a*, radiator panels 7 for radiating heat to the painted objects 2.

The zone interior gases ZA withdrawn through the exhaust openings 6*a*, 6*b*, 6*c* are divided into parts to be led as zone exhaust gases EA to furnace interior exhaust gas passages 8*a*, 8*b*, 8*c* assigned to the respective zones, and parts to be led as zone circulating gases RA to furnace interior circulating gas passages 9*a*, 9*b*, 9*c* assigned to the respective zones. The exhaust gases EA led to the furnace interior exhaust gas passages 8*a*, 8*b*, 8*c* are collected into an exhaust gas collection passage 10, and transmitted through a main exhaust gas passage 11 to a combustion type exhaust cleaning device 12. Fe denotes an exhaust fan.

The exhaust cleaning device 12 includes a burner b and catalyst layers s. This exhaust cleaning device 12 cleans the exhaust gas EA by burning paint solvent vapor (i.e. paint solvent vapor generating from paint films as a result of a baking and drying process in the furnace) contained in the exhaust gas EA under catalysis. Cleaned exhaust gas EA' is outputted to an exhaust gas discharge passage 13.

14 denotes a heat recovering heat exchanger at a hot side for allowing a heat exchange between the untreated exhaust gas EA transmitted through the main exhaust gas passage 11 to the exhaust cleaning device 12 and the hot, cleaned exhaust gas EA' outputted to the exhaust gas discharge passage 13 after the burning treatment, thereby to preheat the untreated exhaust gas EA transmitted to the exhaust cleaning device 12.

15 denotes a heat recovering heat exchanger at a cold side for allowing a heat exchange between fresh air OA (which is ambient air drawn from outside in this example) introduced through a main fresh air passage 16 and the cleaned exhaust gas EA' in the exhaust gas discharge passage 13 after passing through the heat recovering heat exchanger 14 at the hot side, thereby to preheat the fresh air OA. The cleaned exhaust gas EA' after being used for preheating the fresh air OA in the heat recovering heat exchanger 15 at the cold side is discharged from the system through the exhaust gas discharge passage 13.

Each furnace interior circulating gas passage 9*a*, 9*b*, 9*c* has a downstream end thereof connected to the gas supply chamber 5*a*, 5*b*, 5*c* of the corresponding zone, and a filter 17 for cleaning circulating gas RA and a fan Fr for causing the circulation mounted in intermediate positions thereof.

Individual fresh air passages 18*a*, 18*b*, 18*c* for the respective zones 1*a*, 1*b*, 1*c* are branched from the main fresh air passage 16. Each of these fresh air passages 18*a*, 18*b*, 18*c* has a fan Fo mounted thereon for drawing the fresh air. Of these fresh air passages 18*a*, 18*b*, 18*c*, the fresh air passages 18*b*, 18*c* for the first and second heat retaining zones 1*b*, 1*c* are connected to the furnace interior circulating gas passages 9*b*, 9*c* of the corresponding zones.

The fresh air passages 18*b*, 18*c* for the first and second heat retaining zones 1*b*, 1*c* have, acting as furnace interior heating means Hb, Hc for the respective heat retaining zones 1*b*, 1*c*, combustion type furnace interior heating devices 19*b*, 19*c* arranged upstream of points of passage connection to the furnace interior circulating gas passages 9*b*, 9*c* for heating passing fresh air OA by burning operation of burners b. The combustion type furnace interior heating devices 19*b*, 19*c* employed are the direct heating type for burning a fuel directly in the atmosphere of fresh air OA flowing through the fresh air passages 18*b*, 18*c*.

That is, for the first and second heat retaining zone 1*b*, 1*c*, hot fresh air OA' (in particular, air containing combustion gas) heated by the combustion type furnace interior heating devices 19*b*, 19*c* is mixed into the gases RA circulating through the furnace interior circulating gas passages 9*b*, 9*c*, thereby heating, to a high temperature, the gases RA' returning to the heat retaining zones 1*b*, 1*c* from the furnace interior circulating gas passages 9*b*, 9*c* (i.e., gas mixtures of the zone circulating gas RA and hot fresh air OA'). The gases RA' heated to a high temperature are delivered as hot gases from the hot gas supply openings 4 of gas supply chambers 5*b*, 5*c* into the heat retaining zones to heat the heat retaining zones by convection, thereby to adjust the interior temperatures of the respective heat retaining zones 1*b*, 1*c* to a predetermined temperature and to dilute the solvent vapor generated in the respective heat retaining zones 1*b*, 1*c*.

For the temperature increasing zone 1*a*, on the other hand, radiator panels of the hot gas heat source type are employed as radiator panels 7, in which radiating surfaces 7*a* are heated by passing a heat source hot gas through inner gas passages ip to radiate heat from the radiating surfaces 7*a* to the painted objects 2. A radiator circulating gas passage 20 is provided to return gas PA outputted from the inner gas passages ip of the radiator panels 7, to the inner gas passages ip of the radiator panels 7. A combustion type radiator heating device 19*a* is mounted on the radiator circulating gas passage 20 for heating the gas PA circulating through the radiator circulating gas passage 20 by burning operation of a burner b. The combustion type radiator heating device 19*a* employed is the direct heating type, as are the combustion type furnace interior heating devices 19*b*, 19*c* for the first and second heat retaining zones 1*b*, 1*c*, for burning a fuel directly in the atmosphere of gas PA circulating through the radiator circulating gas passage 20.

A shunt gas passage 21 is branched from a gas passage portion of the radiator circulating gas passage 20 which leads the gas PA outputted from the inner gas passages ip of radiator panels 7 to the combustion type radiator heating device 19*a*. The shunt gas passage 21 is connected to the furnace interior circulating gas passage 9*a* of the temperature increasing zone 1*a*. The fresh air passage 18*a* for the temperature increasing zone 1*a* is connected to the radiator circulating gas passage 20 in a position closer to the combustion type radiator heating device 19*a* than a branching position of the shunt gas passage 21. Fp denotes a circulating fan mounted in the radiator circulating gas passage 20.

That is, for the temperature increasing zone 1*a*, the combustion type radiator heating device 19*a* heats a gas mixture of the remainder of the gas PA outputted from the radiator panels 7, after part thereof is branched off into the shunt gas passage 21, and the fresh air OA supplied through the fresh air passage 18*a*. The heated gas PA' (in particular, a gas containing combustion gas) is passed through the inner gas passages ip of radiator panels 7 to radiate heat from the radiating surfaces 7*a* of radiator panels 7 to the painted objects 2.

The hot gas PA branched off into the shunt gas passage 21 is mixed into the gas RA circulating through the furnace interior circulating gas passage 9*a* of the temperature increasing zone 1*a* to heat, to a high temperature, the gas RA' (i.e. a gas mixture of zone circulating gas RA of the temperature increasing zone 1*a* and hot gas PA" supplied from the shunt gas passage 21) returned from the furnace interior circulating gas passage 9*a* to the temperature increasing zone 1*a*. The gas RA' heated to a high temperature is delivered as hot gas from the hot gas supply openings 4 of gas supply chamber 5*a* into the temperature increasing zone to heat the temperature increasing zone by convection, thereby to adjust the interior temperature of the temperature increasing zone 1*a* to a predetermined temperature. At the same time, the gas mixture is introduced from the shunt gas passage 21 as a fresh gas into the temperature increasing zone 1*a* to dilute the solvent vapor generated therein.

That is, zone heating of the temperature increasing zone 1*a* is done by employing a mode in which the gas RA' returned from the furnace interior circulating gas passage 9*a* to the furnace interior 1*a* is heated to a high temperature by dividing and supplying the hot gas PA" by the shunt gas passage 21 from the radiator circulating gas passage 20 to the furnace interior circulating gas passage 9*a* as noted above. Thus, the combustion type radiator heating device 19*a* on the radiator circulating gas passage 20 is made to serve also as furnace interior heating means Ha for the temperature increasing zone.

In short, for the first and second heat retaining zones 1*b*, 1*c*, while using the direct heating type, combustion type furnace interior heating devices 19*b*, 19*c*, fresh air OA containing no paint solvent vapor is heated by the combustion type furnace interior heating devices 19*b*, 19*c*. A furnace interior heating mode is employed in which the heated fresh air OA' is mixed into the gases RA circulating through the furnace interior circulating gas passages 9*b*, 9*c* to heat the zone interiors. For the temperature increasing zone 1*a* including the radiator panels 7, a furnace interior heating mode is employed in which part of the hot clean gas PA in the radiator circulating gas passage 20 containing no paint solvent vapor is divided, and the divided hot clean gas PA" is mixed into the gas RA circulating through the furnace interior circulating gas passage 9*a* to heat the furnace interior. By employing these, the paint solvent vapor contained in the gases RA circulating through the furnace interior circulating gas passages 9*a*, 9*b*, 9*c* is exposed and reacts to burning flame in the direct heating type, combustion type heating devices, to produce a reaction product which would lower paint film quality. It is possible to avoid a situation where the reaction product mixes into the gases returning to the furnace interiors from the furnace interior circulating gas passages 9*a*, 9*b*, 9*c*.

On the other hand, hoods 22*a*, 22*b* are arranged at the inlet and outlet of the furnace, respectively, for collecting furnace interior gases ZA' leaking out through the inlet and outlet. Hood exhaust gas passages 23*a*, 23*b* connected to these hoods 22*a*, 22*b* include hood gas exhaust fans Ff and gas passage opening and shutting dampers Df. The exhaust gas collection passage 10 is connected to the hood exhaust gas passages 23*a*, 23*b* in positions closer to the hoods than the gas passage opening and shutting dampers Df.

That is, in a regular operation as an operating mode of the furnace to perform baking and drying treatment of the painted objects 2 in the furnace, gas passage opening and shutting dampers De of the furnace interior exhaust gas passages 8*a*, 8*b*, 8*c* of the respective zones 1*a*, 1*b*, 1*c* are opened, and gas passage opening and shutting dampers Df of the hood exhaust gas passages 23*a*, 23*b* are closed. Consequently, exhaust gases EA from the respective zones 1*a*, 1*b*, 1*c* and gases ZA' collected by the hoods 22*a*, 22*b* are transmitted to the exhaust cleaning device 12, and the exhaust cleaning device 12 burns the paint solvent vapor contained in these exhaust gases EA and collected gases ZA'.

In a start-up operation as a stage preceding the regular operation to increase the zone temperatures of the respective zones 1*a*, 1*b*, 1*c* to the predetermined temperatures with no painted objects 2 present in the furnace yet, the gas passage opening and shutting dampers De of the furnace interior exhaust gas passages 8*a*, 8*b*, 8*c* of the respective zones 1*a*, 1*b*, 1*c* are closed to stop the exhaust gases from the respective zones 1*a*, 1*b*, 1*c*, thereby to expedite start-up of the zone temperatures. On the other hand, the gas passage opening and shutting dampers Df of the hood exhaust gas passages 23*a*, 23*b* are opened, whereby the hood exhaust fans Ff cause the gases ZA' collected by the hoods 22*a*, 22*b* (i.e. gases not containing paint solvent vapor yet) to be discharged to a fixed discharge location through the hood exhaust gas passages 23*a*, 23*b*.

24*a*, 24*b* in the drawing denote panel heaters for preventing the paint solvent vapor in the furnace interior gases from condensing on ceilings adjacent the inlet and outlet of the furnace. By preventing condensation of the paint solvent vapor with theses panel heaters 24*a*, 24*b*, a situation is avoided where condensed paint solvent drips on the painted objects 2 to lower paint film quality. Moreover, this assures that paint solvent vapors adjacent the inlet and outlet of the furnace are promptly collected along with the furnace interior gases ZA' by the hoods 22*a*, 22*b* and transmitted to the exhaust cleaning device 12.

The panel heaters 24*a*, 24*b* employed are the hot gas heat source type to pass heat source hot gases through inner gas passages ia, ib. For the panel heater 24*a* at the furnace inlet, part of the hot gas PA' transmitted through the radiator circulating gas passage 20 from the combustion type radiator heating device 19*a* to the radiator panels 7 is supplied as heat source hot gas to the inner gas passage ia of panel heater 24*a*. The gas having passed through the inner gas passage ia of panel heater 24*a* is joined to the gas PA outputted from the radiator panels 7. For the panel heater 24*b* at the furnace outlet, part of the hot gas RA' supplied to the gas supply chamber 5*c* in the second heat retaining zone 1*c* is supplied as heat source hot gas to the inner gas passage ib of panel heater 24*b*. The gas having passed through the inner gas passage ib of panel heater 24*b* is joined to the gas ZA withdrawn from the zone 1*c* through the exhaust opening 6*c*.

Figure 2:
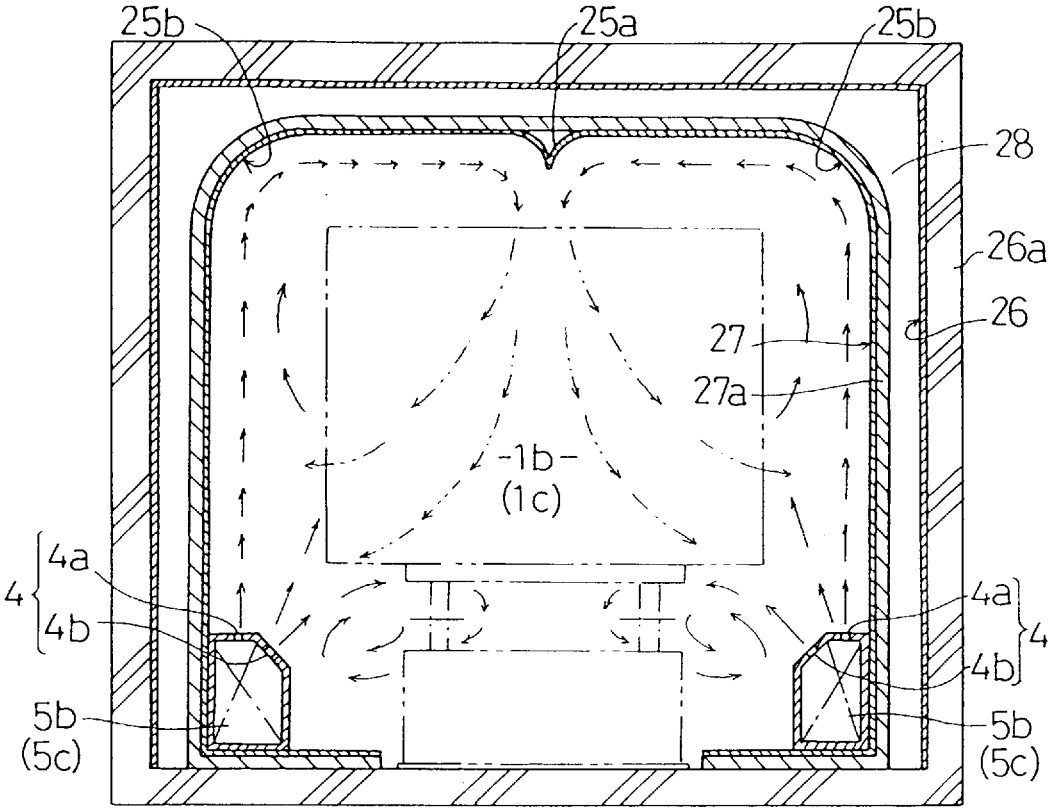
FIG. 2 is a sectional view of a heat retaining zone.

FIG. 2 shows a specific inner structure of the first and second heat retaining zones 1*b*, 1*c*. According to FIG. 2, a pair of gas supply chambers 5*b*, 5*c* extending in the direction of transport of the painted objects 2 are arranged at opposite, left and right ends in the zone bottom. Each of these gas supply chambers 5*b*, 5*c* defines, as the hot gas supply openings 4, upward supply openings 4*a* for blowing hot gas RA' upward along a furnace wall, and oblique supply openings 4*b* for blowing hot gas RA' obliquely upward toward the right and left center in the zone.

Figure 3:
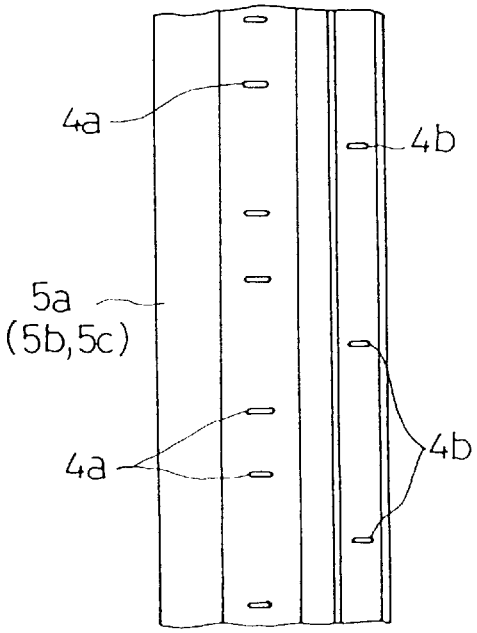
FIG. 3 is a plan view showing hot gas supply openings.

As shown in FIG. 3, these upward supply openings 4*a* and oblique supply openings 4*b* are arranged in respective rows in the direction of transport of the painted objects 2, with each opening in the form of a slit.

Gas flow guides 25*a*, 25*b* extending in the direction of transport of the painted objects 2 are formed at the right and left center of the zone ceiling and at opposite, right and left ends of the zone ceiling for guiding zone interior gas flows as shown in arrows in the drawing. A furnace wall structure comprises a double wall structure including an outer wall panel 26 with an insulating material 26*a* applied thereto, and an inner wall panel 27 with an insulating material 27*a* applied thereto, an insulating layer of air 28 being formed between the inner and outer walls.

While the gas supply chambers 5*b*, 5*c* are arranged in the zones as described above, as for the exhaust side, exhaust chambers are omitted and each heat retaining zone 1*a*, 1*b* has one or two exhaust openings 6*b*, 6*c* opening at the right and left center of the zone ceiling. By omitting exhaust chambers in this way, each heat retaining zone 1*a*, 1*b* has a reduced heat capacity to diminish a start-up heating load during an initial period of operation.

Figure 4:
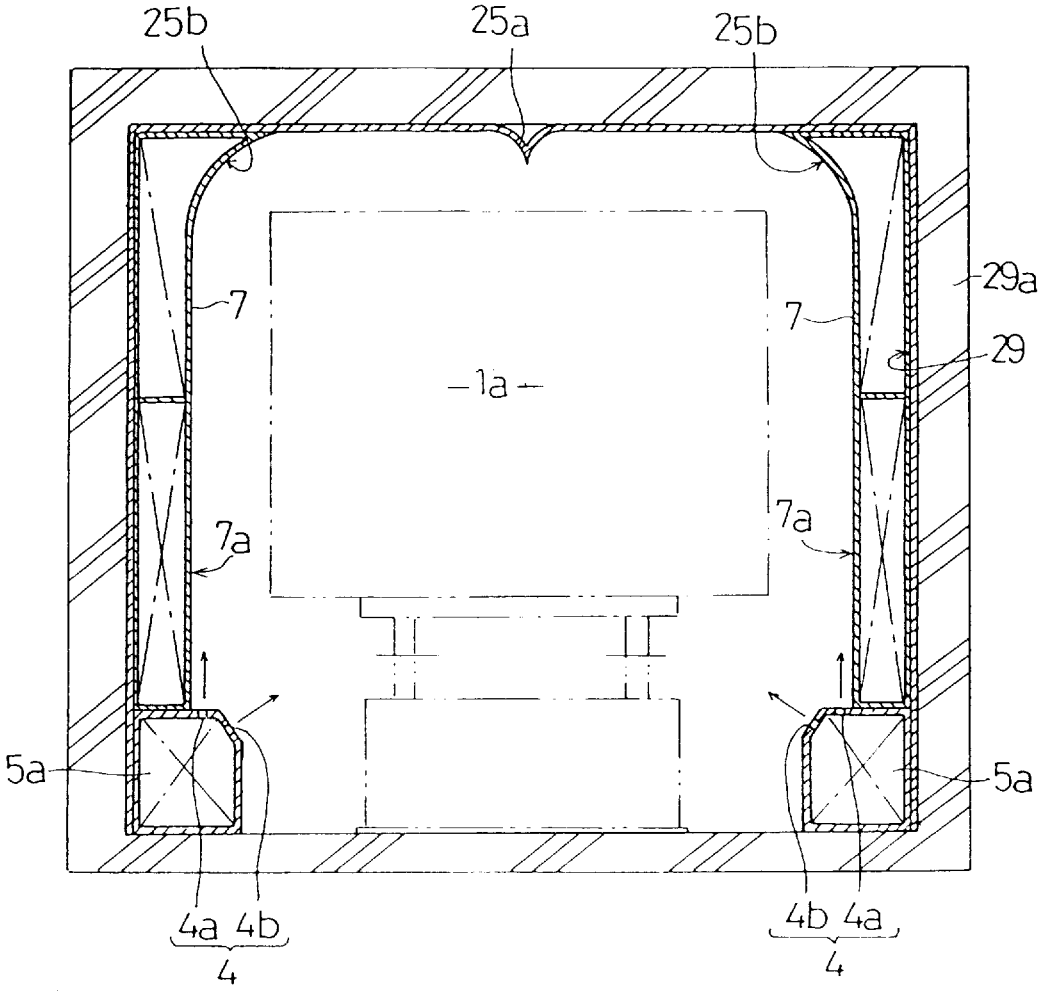
FIG. 4 is a sectional view of a temperature increasing zone.
Figure 5:
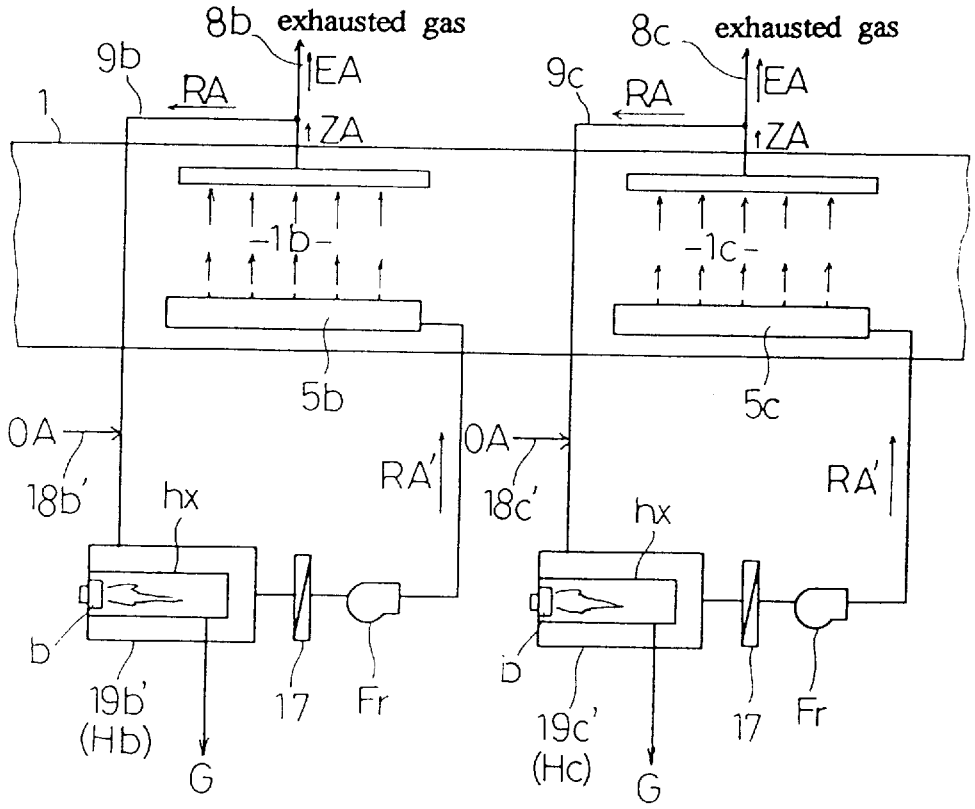
FIG. 5 is a view of a furnace showing the prior art.

On the other hand, a specific inner structure of the temperature increasing zone 1*a*, as shown in FIG. 4, has a pair of gas supply chambers 5*a* extending in the direction of transport of the painted objects 2 and arranged at opposite, right and left ends of the zone bottom. Each of these gas supply chambers 5*a* defines upward supply openings 4*a* and oblique supply openings 4*b* as in the heat retaining zones 1*b*, 1*c*. The radiator panels 7 are arranged on opposite furnace walls above these gas supply chambers 5*a*.

Gas flow guides 25*a*, 25*b* are provided as in the heat retaining zones 1*b*,1*c*. As for the exhaust, exhaust chambers are omitted as in the heat retaining zones 1*b*, 1*c*, and one or two exhaust openings 6*a* open at the right and left center of the zone ceiling. By omitting exhaust chambers in this way, large areas of the radiating surfaces 7*a* are secured for the radiator panel 7.

In the furnace wall structure of temperature increasing zone 1*a* in the example shown in FIG. 4, the furnace wall in the temperature increasing zone 1*a* is formed only of a single wall panel 29 with an insulating material 29*a* applied thereto. Where appropriate, a double wall structure as in the heat retaining zones 1*b*, 1*c* may be employed also for the temperature increasing zone 1*a*.

(1) In the foregoing embodiment, the invention defined in claim 1 is applied to the first and second heat retaining zones 1*b*, 1*c* in the furnace. In a furnace construction in which the furnace interior is divided into a plurality of zones, the invention defined in claim 1 may be applied to all of these zones. The invention defined in claim 1 may be applied to a furnace construction having no divided zones.

(2) In the foregoing embodiment, ambient air is used as fresh air OA. Fresh air OA may be varied types of air as long as furnace interior gas ZA is not contained, such as indoor air of a painting plant, or cleaned exhaust air from a different apparatus.

(3) The inner structure of the furnace is not limited to the inner structures shown in FIGS. 2 and 4 but may be varied in may ways.

The terms and expressions which have been employed are used as terms of description and not of limitation, and there is no intention in the use of such terms and expressions of excluding any equivalents of the features shown and described or portions thereof; it being recognized that various modifications are possible within the scope of the invention.

We claim:

1. A paint drying furnace having an interior, the furnace comprising:

furnace interior circulating gas passages for withdrawing furnace interior gases from the furnace interior and returning the withdrawn gases to the furnace interior;

a fresh air passage connected to the furnace interior circulating gas passages for mixing fresh air into the gases circulating through the furnace interior circulating gas passages; and a combustion type heating device for heating the gases returned from the furnace interior circulating gas passage to the furnace interiors, thereby to heat the furnace interiors, wherein the combustion type heating device is arranged on said fresh air passage upstream of a connection to said furnace interior circulating gas passages for heating passing fresh air.

2. The paint drying furnace of claim 1 wherein said combustion type heating device is a direct heating type for burning a fuel in an atmosphere of passing fresh air to be heated.

3. The paint drying furnace of claim 1 further comprising a combustion type exhaust cleaning device for burning paint solvent vapor contained in exhaust gases from the furnace interiors to clean the exhaust gases.

4. The paint drying furnace of claim 3 further comprising a heat recovering heat exchanger for a heat exchange between the cleaned exhaust gases and the fresh air to preheat the fresh air.

5. The paint drying furnace of claim 4 wherein said fresh air passage is an air passage for leading the fresh air preheated at said heat recovering heat exchanger to said furnace interior circulating gas passages through said combustion type heating device.

6. The paint drying furnace of claim 1 wherein said furnace interiors have at least one gas supply chamber extending in a direction of transport of painted objects and arranged at an end of a bottom of said furnace interior, said gas supply chamber defining hot gas supply openings.

7. The paint drying furnace of claim 6 wherein said hot gas supply openings include supply openings for blowing hot gas upward along a furnace wall, and oblique supply openings for blowing the hot gas obliquely upward toward the right and left center in the zone.

* * * * *

UNITED STATES PATENT AND TRADEMARK OFFICE

CERTIFICATE OF CORRECTION

PATENT NO. : 5,868,562

DATED : February 9, 1999

INVENTOR(S) : Watanabe et al.

It is certified that error appears in the above-identified patent and that said Letters Patent is hereby corrected as shown below:

Title page, in the section titled Assignee, change "Kaikisha" to --Taikisha--.

In column 1, line 7, after "process," add --and--.

Signed and Sealed this

Thirty-first Day of August, 1999

*Attest:*

Q. TODD DICKINSON

*Attesting Officer*

*Acting Commissioner of Patents and Trademarks*